US008869728B1

(12) United States Patent
Paugh

(10) Patent No.: US 8,869,728 B1
(45) Date of Patent: Oct. 28, 2014

(54) BOAT ANCHOR

(76) Inventor: Josh Paugh, Devore, CA (US)

( * ) Notice: Subject to any disclaimer, the term of this patent is extended or adjusted under 35 U.S.C. 154(b) by 302 days.

(21) Appl. No.: 13/423,094

(22) Filed: Mar. 16, 2012

(51) Int. Cl.
*B63B 21/24* (2006.01)

(52) U.S. Cl.
USPC ..... 114/303

(58) Field of Classification Search
USPC ..... 114/294–310
See application file for complete search history.

(56) References Cited

U.S. PATENT DOCUMENTS

| | | | | |
|---|---|---|---|---|
| 4,111,147 | A | 9/1978 | Morisette | |
| 4,230,062 | A | 10/1980 | Fornasiero | |
| 4,385,584 | A | 5/1983 | Simpson, III | |
| 4,403,564 | A * | 9/1983 | Garvin | 114/299 |
| 4,596,202 | A | 6/1986 | Brewster | |
| 4,655,158 | A | 4/1987 | Holder | |
| 4,945,850 | A | 8/1990 | Steinhoff | |
| 4,951,593 | A | 8/1990 | Brown et al. | |
| 5,092,261 | A | 3/1992 | Bertrand | |
| 5,188,055 | A | 2/1993 | Kershner | |
| 5,469,802 | A | 11/1995 | Ivicevic | |
| 5,850,802 | A | 12/1998 | Dvorak | |
| 5,934,219 | A | 8/1999 | Poiraud | |
| 6,009,826 | A | 1/2000 | Nole | |
| 6,119,618 | A | 9/2000 | Giles | |
| 6,626,123 | B1 | 9/2003 | MacKarvich | |

* cited by examiner

*Primary Examiner* — Daniel V Venne
(74) *Attorney, Agent, or Firm* — Eric Gani

(57) ABSTRACT

A detachable boat anchor comprises of a first plate having a housing on the bottom central surface and a second plate having a housing on the top central surface. The two plates are connected by a central shank by means of a leaf spring with engagement pin. The shank has two open ends with radial holes formed therethrough proximate to the open ends. The housing has an open end and radial holes formed therethrough and is shaped to receive the shank in a mating relationship to provide a snug fit such that when the radial holes of the shank and the radial holes of the housing are aligned, the engagement pin protrudes from the radial holes to prevent disengagement.

4 Claims, 4 Drawing Sheets

BOAT ANCHOR

TECHNICAL FIELD

The present invention relates generally to boat anchors and more particularly to a boat anchor that can be quickly assembled for use and easily disassembled for compact storage

BACKGROUND OF THE INVENTION

An anchor is a device that is attached to a vessel and dropped into the bottom of a body of water to prevent or restrict the vessel or other floating objects from drifting due to wind or current. Anchors typically achieve holding power either by hooking into the bottom or via sheer mass, or a combination of the two. The vessel is attached to the anchor by an anchor line which is made of chain, cable, rope or a combination of these. The earliest anchors were probably rocks. In ancient times, people used basket of stones, and large sacks filled with sand. Such anchors held the vessel merely by their weight and by their friction along the bottom. Iron was afterwards introduced for the construction of anchors, and an improvement was made by forming them with flukes to bury themselves into the bottom.

One of the earliest design and most well known anchors is probably the admiralty or fisherman anchor which consists of a straight bar having at one end a straight crossbar, called the stock, and at the other a pair of curved flukes. Once the anchor lands on the bottom, a pull on the chain will generally tends to cause the fluke to digs into the bottom. The object of the stock is to help ensure the anchor can take up the most favorable position no matter how it is thrown overboard. Many new improvements to anchor design have been introduced since then including the CQR, Claw, Spade, Delta, Danforth, Rocna, etc.

There are several criterion that are necessary for a good anchor: the anchor must have good holding power and work in a variety of bottom conditions, the anchor must be able to set and reset itself quickly, the anchor design must not allow the anchor line to become snagged by the anchor. In addition, it needs to be lightweight enough to be quickly and easily deployed by the user and convenient to store. This last criterion is especially important for smaller recreational boats found in the shallower water of lakes, rivers, and inland waterways.

The traditional anchor types are made in one piece and are generally bulky and heavy making it hard to transport and present a problem for storage. Modern anchor types have been introduced to provide anchors that meet the criterion outlined above. However, none of these anchors provide the novelty of the present invention that introduces an improved detachable boat anchor that provides portability and compact storage in a disassembled state and offers good holding power that is suitable and effective for a variety of bottom conditions

SUMMARY OF THE INVENTION

The present invention is directed to an improved detachable boat anchor comprising of two substantially identical plates having two flukes on each of its two opposed sides. A hollow shank is inserted into the housing located on the bottom central surface of the first plate on one end and to another housing located on the top central surface of the second plate on the other end. The shank is secured to the housing by means of a resilient leaf spring with engagement pin to provide an easy connect and disconnect feature of the boat anchor assembly. The flukes are angled upward at the distal end in relation to its respective plates. The fixed flukes design of the anchor allows it to quickly and easily sets itself in a variety of bottom conditions such as sand, mud, rock, or grass. A lead arm is provided to connect an anchor line to the anchor and to prevent fouling of the anchor line.

The anchor of the present invention does not have any hinge or other moving parts that can jam or foul or present problems of corrosion and poor operation at the hinge as well as potential hazard to the user who handles and works with the anchor. The simple design, minimum number of parts and rigid construction of the anchor presented in the current application means that the anchor presented herein can be manufactured economically and is durable or long lasting, thus providing a good value for the money.

In view of the above disclosure, it is an object of the present invention to provide a boat anchor that can be quickly assembled for use and easily detachable for compact storage.

Another object of the invention is to provide a boat anchor that is lightweight, portable and effective in various bottom conditions.

It is also an object of the invention to provide a boat anchor that has the ability to set and reset itself when there is a change in direction yet easy to retrieve.

These and other objects of the invention will be made apparent to one of skill in the art upon a review of this specification, the associated drawings and the appended claims.

BEST MODES OF CARRYING OUT THE INVENTION

Figure 1:
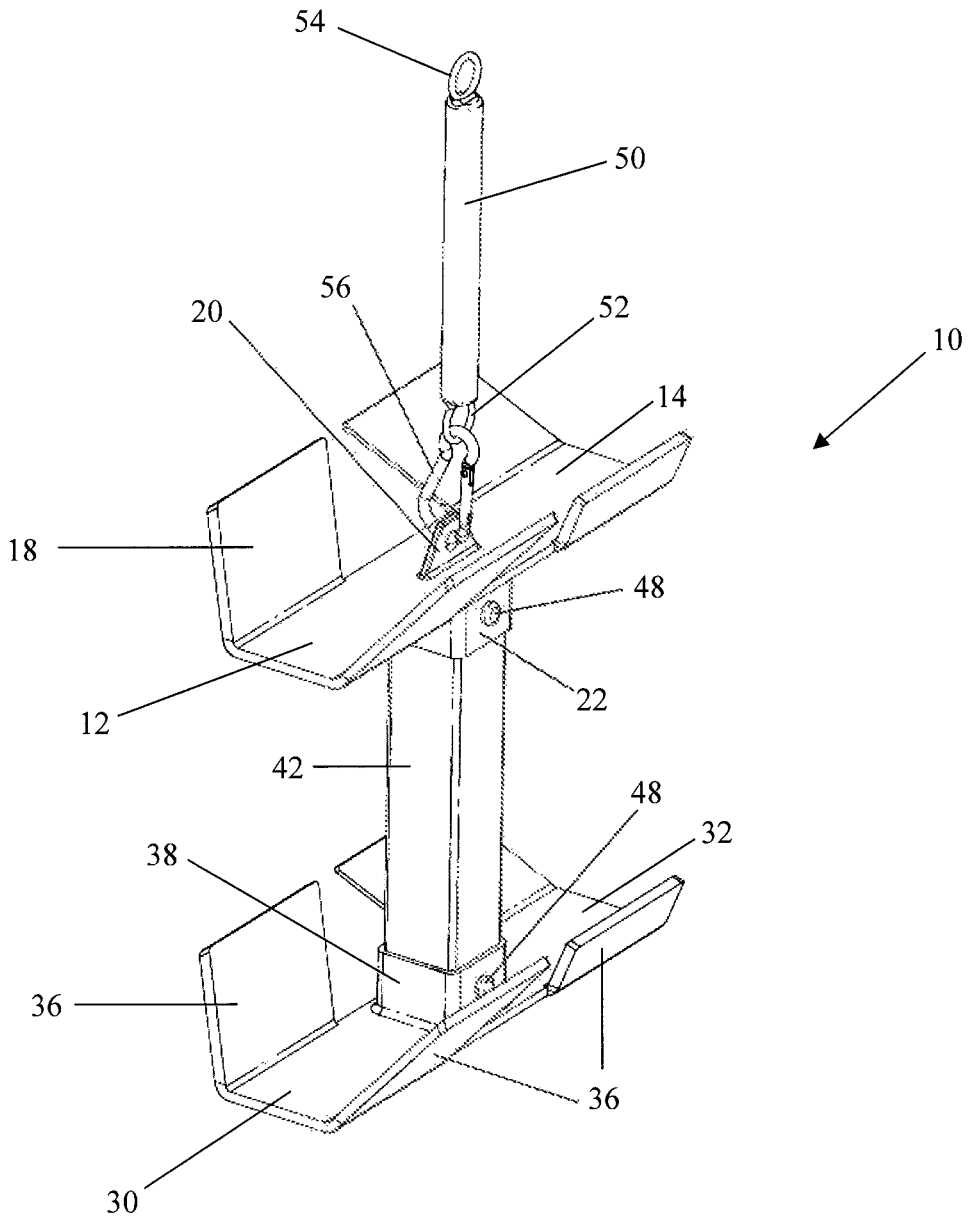
FIG. 1 is a perspective view of the preferred embodiment of the boat anchor according to the present invention.
Figure 2:
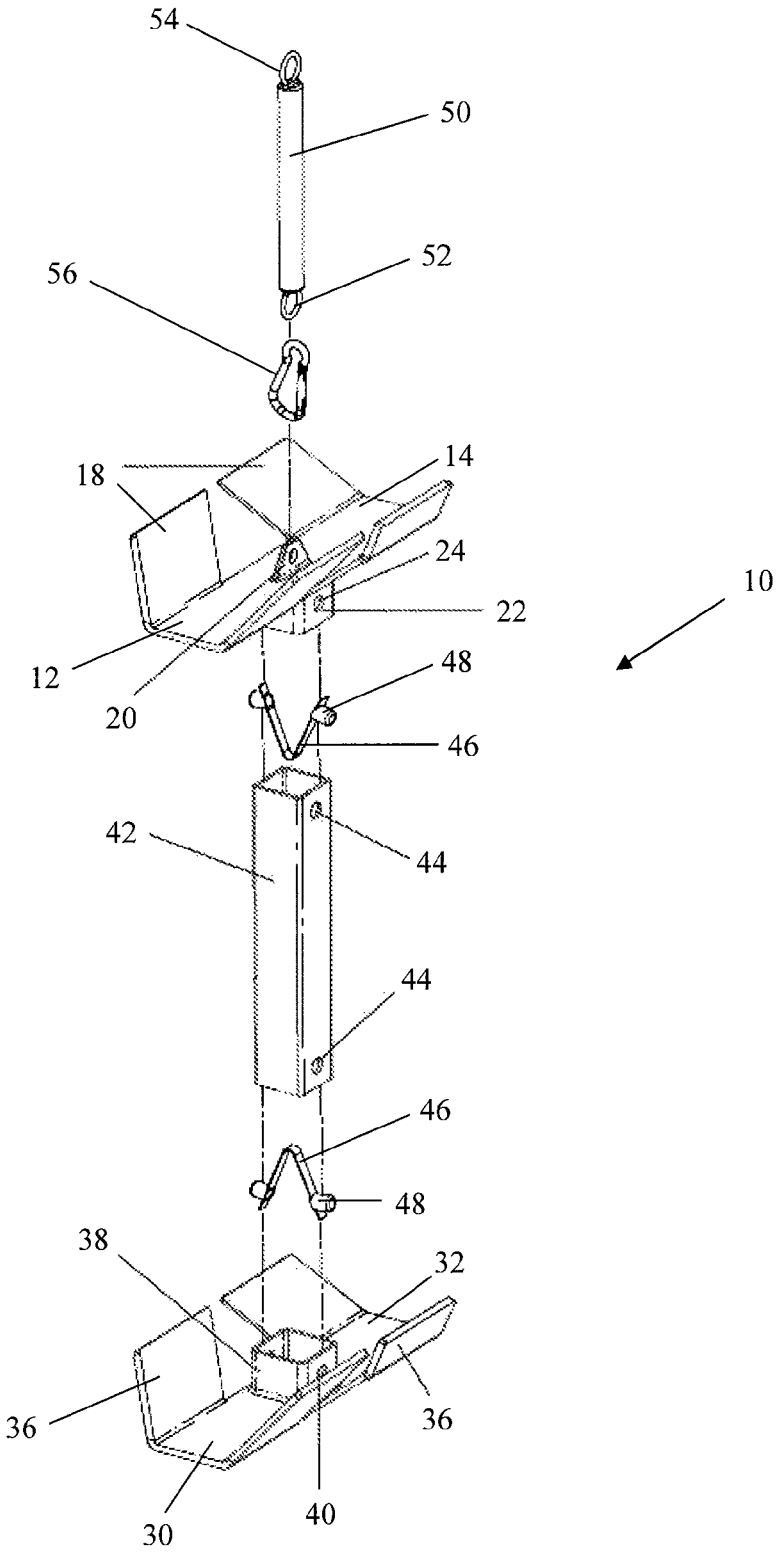
FIG. 2 is an exploded view of the preferred embodiment of the boat anchor according to the present invention.
Figure 3:
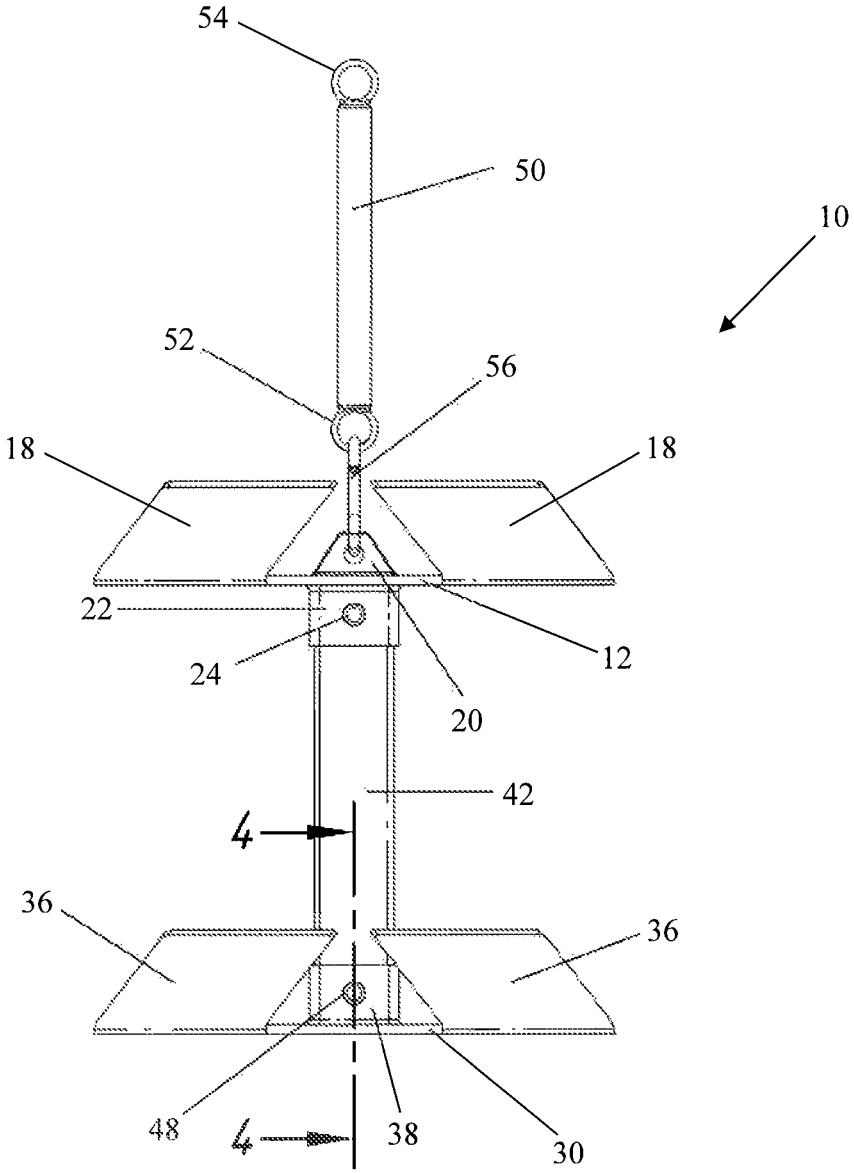
FIG. 3 is a front view of the preferred embodiment of the boat anchor according to the present invention.
Figure 4:
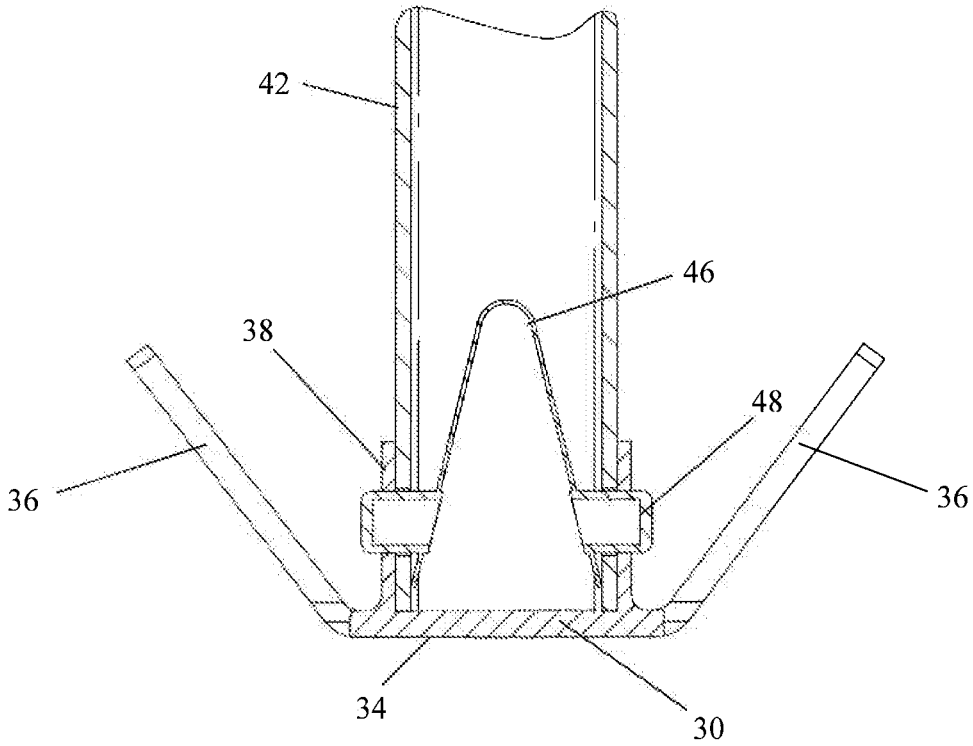
FIG. 4 is a side cross sectional view taken along line 4-4 of FIG. 3 showing the shank being releasably attached to the housing by means of a leaf spring pin assembly.

The best mode of carrying out the invention is presented in terms of a preferred embodiment of a boat anchor 10 as shown in FIG. 1-5. The boat anchor according to the present invention comprises of a first rectangular plate 12 having a top surface 14, a bottom surface 16 and one or more flukes 18 on each of its long sides, and a second rectangular plate 30, substantially identical to the first plate 12, having a top surface 32, a bottom surface 34 and one or more flukes 36 on each of its long sides. A centrally located shank 42 is used to connect the first plate 12 to the second plate 30. The first plate 12 is shown in FIG. 1-3 with an anchor pull ring 20 attached to the top central surface 14 and a housing 22 protruding from the bottom central surface 16. The second plate 30 is shown in FIG. 1-3 with a housing 38 protruding from the top central surface 32. The preferred shape of the plate 12 and 30 would be of a rectangle while the shank 42 would be of an elongated rectangular tubes or bars. However, other shapes of plates 12 and 30 and shank 42 combination can be employed to have comparable utility and efficiency to the embodiment of the boat anchor 10 shown in FIGS. 1-5 and described herein.

The preferred embodiment would have the flukes 18 and 36 all of equal size with the distal end of each fluke 18 and 36 angled upward in relation to its respective plate 12 and 30 as shown in FIG. 1-3. The flukes 18 and 36 are adapted to embed into the bed of a body of water. It is to be noted that the actual length, width, shape, angle and number of flukes, and/or their relation in size to each other could vary depending on the application. As shown in FIG. 1-3, a lead arm 50 assembly is presented and has an anchor attachment ring 52 that is connected to the anchor pull ring 20 by means of a carabiner 56 to provide easy connect and disconnect feature. However, alternative method of connecting the lead arm 50 to the anchor pull ring 20 can also be employed such as using a conventional snap ring or shackle (not shown). A welded link (not shown) can also be provided such that the ring 52 on the lead arm 50 is directly connected to the anchor pull ring 20. This interconnection actually would be made prior to affixing the pull ring 20 to the plates. At the opposite end of the lead arm 50 is a line attachment ring 54 that is used to tie off a conventional anchor line, which is in turn tied to the boat.

The plates 12 and 30, shank 42, and lead arm 50 are preferably made of the same material and can be made from any materials commonly known in the art of making boat anchor. Preferably the plates 12 and 30, shank 42 and lead arm 50 are made of a thick rigid material such as steel (galvanized or stainless). However, aluminum or iron would also be suitable.

According to the preferred embodiment, a connector assembly as shown in FIG. 2 is used for connecting the shank 42 to the plates 12 and 30. The shank 42 extends longitudinally and has two open end portions and radial holes 44 formed therethrough proximate to the open end thereof. The housing 22 and 38 has an open end portion and radial holes 24 and 40 formed therethrough. The connector assembly as shown in FIG. 2 includes a resilient leaf spring 46 with two opposite ends and an engagement pin 48 fixed thereon proximate to the end thereof. An intermediate portion of the leaf spring 46 is pressed downward relative to the shank 42 in such a manner that the opposite ends of the leaf spring 46 are inserted into and frictionally engage an inner surface of the open end portion of the shank 42 while the engagement pin 48 protrudes outwardly of the radial holes 44. The housing 22 and 38 defines an inner circumferential wall of a dimension slightly larger than an outer circumference of the open end portion of the shank 42 so that the housing 22 and 38 can be brought in the longitudinal direction to connect with the shank 42 in a mating relationship to provide a snug fit in such a manner that when the radial holes 44 of the shank 42 and the radial holes 24 and 40 of the housing 22 and 38 are aligned, the engagement pins 48 also protrude outwardly of the radial holes 24 and 40 of the housing 22 and 38 to prevent disengagement.

The perimeter of shank 42 open ends is shown in FIG. 2 and accompanying figures as being generally square. It is understood that other perimeters for either of these two ends could have any plurality of shapes, such as round, polygonal, rectangular or the like. The housing 22 and 38 defines a shape and size that is configured to match the shape and size of the shank 42 providing a mating relationship and a snug fit when engaged. In the preferred embodiment of this invention, shank 42 is releasably attached to the housing 22 and 38 with a leaf spring pin assembly 46 as shown in FIG. 2. Leaf spring pin 46 is an embodiment of a connecting means for detachably connecting shank 42 with the housing 22 and 38. Alternatively, the shank 42 can also be connected to the housing 22 and 38 by means of other conventional mechanical connector means such as a spring plunger, a spring loaded pin, a bolt assembly, a screw assembly, a snap-in connector, or the like.

Figure 5:
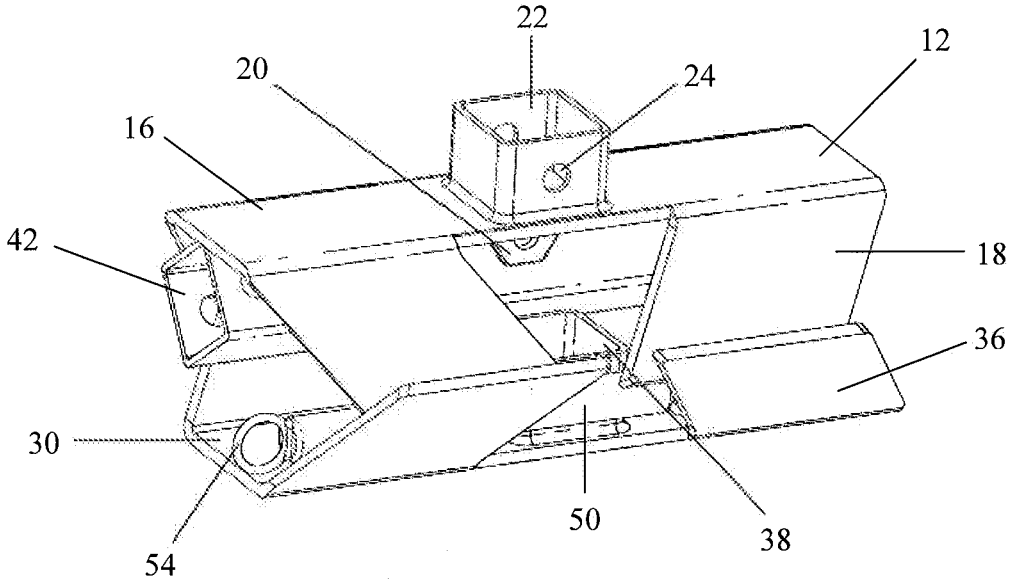
FIG. 5 is a perspective view showing the boat anchor in a disassembled state for storage.

In operation, the anchor 10 can be quickly and easily assembled from its disassembled state by inserting the shank 42 into the housing 22 and 38 of the respective plates 12 and 30. The engagement pin 48 will snap in place and protrudes out of the radial hole 24 and 40 of the housing 22 and 38 and securely lock the anchor assembly. With the anchor line (not shown) tied to the lead arm 50 and attaching the lead arm 50 to the anchor pull ring 20, the anchor 10 is ready for use. The anchor 10 can be quickly and easily detached into separate pieces as shown in FIG. 5 for easy transport and compact storage. To disassemble, simply press the engagement pin 48 inward into the housing 22 and 38 and pull the shank 42 and the plate 12 and 30 in an opposite direction to separate the pieces. The two plates 12 and 30, shank 42 and the lead arm 50 can then be stacked on top of one another for storage as depicted in FIG. 5. The size and weight of the anchor 10 according to the present invention can be scaled accordingly depending on the application. Heavier and larger anchor can be manufactured for larger boats while lighter and smaller anchor can be used for smaller boats.

The anchor's fixed shank 42 design provides a strong foundation for the boat anchor 10 and ease of handling for the users. The anchor's fixed flukes design allows the anchor 10 to quickly and easily set into a variety of bottom conditions including sand, mud, rock, or grass. The design of the anchor 10 also allows it to always land upright and ready for use. Should the anchor 10 land on its short sides, the slightest movement from the anchor line will cause the anchor 10 to tip over and roll onto its long sides where the flukes 18 and 36 are, one side or the other. If the wind or current change, the anchor 10 will roll over and land on its other side and has the ability to resets itself. Retrieving the anchor 10 is also relatively easy since the anchor 10 is designed to have minimum upward resistance. A vertical pull of the anchor 10 will result in the anchor 10 to come off the bottom due to the lack of upward facing surface area.

Although the invention has been described in some detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claim.

The invention claimed is:

1. A boat anchor comprising of:

a) a first rectangular plate having a top surface, a bottom surface and four sides, wherein an anchor pull ring is mounted on the top surface, a housing protrudes from the bottom surface, and one or more flukes affixed to at least one of the sides;

b) a second rectangular plate having a top surface, a bottom surface and four sides, wherein a housing protrudes from the top surface and one or more flukes affixed to at least one of the sides;

c) a shank being releasably attached to said first plate on one end and to said second plate on another end;

d) a lead arm having an anchor attachment ring on one end for connection to an anchor pull ring and a line attachment ring on another end for connection to an anchor line;

wherein said anchor can be quickly assembled for use and easily detached into separate pieces for compact storage and said housing has an open end and one or more radial holes formed therethrough.

2. The boat anchor as specified in claim 1 wherein the shank has an open end and one or more radial holes formed therethrough proximate to the open end.

3. The boat anchor as specified in claim 1 wherein the shank is attached to the first plate and to the second plate by using a mechanical assembly that secure the shank to the housing of said first plate and to the housing of said second plate.

4. The boat anchor as specified in claim 3 wherein the mechanical assembly include but not limited to a leaf spring with engagement pin, a spring plunger, a spring loaded pin, a bolt assembly, a screw assembly, or a snap-in connector.

* * * * *